US010077558B2

(12) United States Patent
Heo

(10) Patent No.: US 10,077,558 B2
(45) Date of Patent: Sep. 18, 2018

(54) ROOF EDGE STRUCTURE FOR SECURING ROOFING MATERIALS

(71) Applicant: Bal Heo, Alpharetta, GA (US)

(72) Inventor: Bal Heo, Alpharetta, GA (US)

( * ) Notice: Subject to any disclaimer, the term of this patent is extended or adjusted under 35 U.S.C. 154(b) by 0 days.

(21) Appl. No.: 15/833,971

(22) Filed: Dec. 6, 2017

(65) Prior Publication Data

US 2018/0209152 A1 Jul. 26, 2018

Related U.S. Application Data

(63) Continuation-in-part of application No. 15/411,961, filed on Jan. 20, 2017.

(51) Int. Cl.
*E04D 13/15* (2006.01)
*E04D 13/04* (2006.01)

(52) U.S. Cl.
CPC ..... *E04D 13/15* (2013.01); *E04D 13/0459* (2013.01)

(58) Field of Classification Search
CPC . E04D 13/158; E04D 13/0459; E04D 13/076; E04D 2013/0468; E04D 13/155; E04D 2013/0486; E04D 2013/0463
See application file for complete search history.

(56) References Cited

U.S. PATENT DOCUMENTS 397,534 A * 2/1889 Carroll ..... E04D 13/064 52/15
3,668,811 A * 6/1972 Pollard ..... E04D 13/15 52/60
3,738,068 A * 6/1973 Attaway ..... E04D 13/155 52/60
4,254,594 A * 3/1981 Hammond ..... E04D 13/064 52/11
4,339,898 A * 7/1982 Pichette ..... E04D 13/158 52/278
4,419,850 A * 12/1983 Butzen ..... E04D 13/155 52/60
4,483,112 A * 11/1984 Rueblinger ..... E04D 13/155 52/58
4,549,377 A * 10/1985 Castle ..... E04D 13/155 52/94
4,641,476 A * 2/1987 Webb ..... E04D 13/155 52/60
4,665,667 A * 5/1987 Taylor ..... E04D 13/155 52/96
4,780,997 A * 11/1988 Taylor ..... E04D 13/15 52/96
4,780,999 A * 11/1988 Webb ..... E04D 13/155 52/60
4,800,689 A * 1/1989 Lane ..... E04D 13/155 52/60

(Continued)

*Primary Examiner* — Rodney Mintz
(74) *Attorney, Agent, or Firm* — Young Jeon

(57) ABSTRACT

A ridge structure at a roof edge, having a base panel lying on a roof surface and a hollow ridge structure over the base panel. The hollow ridge structure is constructed in a flat spring form along the eaves, and therefore one slope of the ridge faces the roof and the other slope the opposite direction. The slope facing the roof can be lifted to receive and secure roofing materials between the slope and the base panel. When water flows down the roof surface, most water flows over the ridge structure and the rest flows into the hollow space inside the ridge structure and drains through drain holes on the base panel.

5 Claims, 5 Drawing Sheets

(56) References Cited

U.S. PATENT DOCUMENTS 4,848,045 A * 7/1989 Nichols ..... E04D 13/155 52/60
5,031,367 A * 7/1991 Butzen ..... E04D 13/155 52/300
5,170,597 A * 12/1992 Stearns ..... E04D 13/0459 52/11
5,251,411 A * 10/1993 Kelley ..... E04D 13/064 156/290
5,272,846 A * 12/1993 Kelley ..... E04D 13/064 52/300
5,414,965 A * 5/1995 Kelley ..... E04D 13/064 52/60
5,640,810 A * 6/1997 Pietersen ..... E04D 13/076 210/474
5,735,084 A * 4/1998 Zaccagni ..... E04D 13/064 52/11
5,848,857 A * 12/1998 Killworth ..... E04D 13/076 405/118
5,927,023 A * 7/1999 Kittilstad ..... E04D 13/155 52/60
5,960,591 A * 10/1999 Schluter ..... E04D 13/0459 52/11
6,035,587 A * 3/2000 Dressler ..... E04D 13/0459 52/716.2
6,237,293 B1 * 5/2001 Gembala ..... E04D 13/0431 52/302.6
6,578,322 B2 * 6/2003 Kintop ..... E04D 13/155 52/300
6,725,617 B2 * 4/2004 Cox ..... E04B 5/10 52/302.6
6,845,590 B1 * 1/2005 Mills, Jr. ..... E04D 13/155 52/60
7,735,267 B1 * 6/2010 Ayers, Jr. ..... E04D 13/155 52/302.6
8,549,791 B1 * 10/2013 Loughren ..... E04D 13/158 52/11
8,739,470 B1 * 6/2014 Wayne ..... E04D 13/15 52/58
2003/0159379 A1 * 8/2003 Pickler ..... E04D 13/0459 52/283
2005/0193639 A1 * 9/2005 Knudson ..... E04D 13/076 52/12
2008/0196321 A1 * 8/2008 Kronemeyer ..... E04D 13/0459 52/60
2014/0033618 A1 * 2/2014 Loughren ..... E04D 13/076 52/12
2017/0145697 A1 * 5/2017 Anthony ..... E04D 13/0727

* cited by examiner

ROOF EDGE STRUCTURE FOR SECURING ROOFING MATERIALS

CROSS-REFERENCE

This application is a continuation-in-part of prior application Ser. No. 15/411,961, filed Jan. 20, 2017. All materials in the prior Application are incorporated herein by reference.

TECHNICAL FIELD

The invention relates to the field of special arrangements or devices that are used in connection with roof coverings. More specifically, the invention relates to the devices and methods implemented at the edge of the roof in order to protect roof coverings from environmental damages such as bird, wind, and precipitation and at the same time to form drainage borders for directing water flow away from the building structure. The invention further relates to roofing edge strips that provide a securing means for roof coverings along the edge of a roof.

BACKGROUND ART

A roof of a modern building is typically composed of multiple elements including framing, insulation, ventilation, sheeting, flashing and covering. These elements can independently or together support the roof structure and improve the functionality of the building. Especially the covering materials, commonly called roofing materials, are important because they shield and protect the other elements from environmental factors such as wind, moisture, precipitation, ultraviolet light, and activities of living organisms. Further, the roofing materials are visible to a person outside of the building and therefore often serve as an ornamental feature of a building. To meet the functional and aesthetic requirements, there are diverse roofing materials developed and used for covering the roof including asphalt shingles, cedar shakes, concrete or ceramic tiles, metal sheets, and rubber.

The covering of a roof most importantly forms a barrier to all kinds of water from vapor to liquid and solid. Although roofing materials are often waterproof or highly water-resistant, installing them on the roof often creates inevitable gaps between pieces of roofing materials, perforations due to nailing and screwing, and intentional gaps for ventilation, among others. They are all prone to leakage, so it is advantageous for a roof surface to be drained as quickly as possible.

A pitched roof makes the drainage effortless as the liquid water would run down the slope due to the earth's gravitational pull. The water then exits the roof surface from the edge of the roof, and the roof edges typically extend beyond the side of a building and create eaves that distance the water from the side walls of a building. However, the side of the roof overhang, which is often the fascia board, is susceptible to water damage. In an effort to prevent water damages to the side of the roof, a metal flashing or other overhanging pieces with an outwardly projecting lower edge are installed along the edges of a pitched roof and direct the falling water away from the side. These pieces are usually made of non-corrosive and non-staining materials and commonly called drip edges.

Drip edges are widely adopted and became an essential part of a roof construction. U.S. Pat. No. 4,254,594 to Hammond et al. discloses a drip edge having an extended flat portion that is parallel to the roof along with a projecting lower edge. When installed, a part of the the flat portion lies flat on the roof and is covered by roofing materials. This flat portion prevents water from entering the gap between the roofing materials and the drip edge. U.S. Pat. No. 5,170,597 to Stearns discloses a particular design of a lower edge in favor of better drainage and better protection of the side of the building. U.S. Pat. No. 6,035,587 to Dressler discloses a drip edge with a flexible lower edge that can be adjusted to fit over gutters. Each drip edge can be easily installed by nailing or screwing them on top of the roof. Although the nailed or screwed regions are prone to leak, they will be covered by the roofing materials. The roofing materials in turn are affixed to the roof to prevent water intrusion and to resist wind.

The problem with having roofing materials to cover the drip edges arises because the roofing materials deteriorate over time. For example, asphalt shingles contain mineral fillers that birds may peck and ingest in order to help digestion. Also, asphalt shingles on the edge of the roof generally project from the edge of the roof by up to a half inch to one and a half inch. These overhangs in a long run sag at the tip because the tip of the asphalt shingle without the support of the roof structure would eventually give way to the gravitational pull. These sagging edges create unappealing appearance, and the bird damage exposes the underlying roofing elements. The objective of the present invention is to address this shortcoming.

Drip edges for flat roofs and built up roofs are designed to receive and cover the edge of roofing materials although the application is limited to pliable roofing materials. For example, U.S. Pat. No. 4,483,112 to Rueblinger, U.S. Pat. No. 6,578,322 to Kintop, and U.S. Pat. No. 6,845,590 to Mills disclose roof edge assemblies. In each of the disclosures, the assembly includes three members, generally a base plate, a cover plate, and a clip. The base plate lies on top of the roof and forms a vertical rise at the edge. The roofing membrane lies on top of the base plate and typically extends beyond the vertical rise and cover at least a portion of the side structure of the roof or the building. The cover plate lies on top of the base plate and the membrane and typically covers the side of the building as well, and the clip secures the members together at the vertical rise where the plates and the membrane overlap. These drip edges are designed to affix thin and pliable roofing materials at the edge of the roof and secure them against wind and water. Thicker roofing materials such as asphalt shingles are not compatible with these types of drip edges.

The problem with the drip edges disclosed in U.S. Pat. No. 4,254,594 to Hammond et al., U.S. Pat. No. 5,170,597 to Stearns, and U.S. Pat. No. 6,035,587 to Dressler is that they must be installed under the roofing materials, and the roofing materials diminish in terms of their physical strength and appearance. U.S. Pat. No. 4,483,112 to Rueblinger, U.S. Pat. No. 6,578,322 to Kintop, and U.S. Pat. No. 6,845,590 to Mills provides a way to cover roofing materials with metal flashings, but the application is limited to thin and pliable materials used for a flat roof. Asphalt shingles in particular are not thin or pliable and susceptible to bird pecking and sagging at the tip, which leads to frequent repair and unseemly appearance.

BRIEF SUMMARY

The invention is related to a roof edge construction where a small ridge is created along the edge of a roof. The ridge structure is a distinctive and separate feature of a roof than the roof ridge, which is the horizontal top area where two sloped roof areas meet in a sloped roof system. Here, a ridge structure refers to a slight elevation of surface along an axis along the edge of a roof, which results in a long and narrow hilltop along the eaves. The ridge structure of the present invention is typically formed on top of drip edges along the roof edge. A drip edge is a metal flashing or other overhanging component with an outward projecting lower edge, intended to control the direction of dripping water and help protect underlying building components. An edge of roofing material can be inserted through a slit along the ridge structure. Roofing material is generally the outermost protective layer on the roof, but the ridge structure can further protect the roofing materials from bird and wind damage.

The ridge structure has a drain hole or holes in addition to the slit. When water flows toward the slit side of the ridge structure, most water flows over the ridge structure because the slit is already filled by roofing materials and leaves a relatively small gap, but some may still flow or leak into the ridge structure. The water is drained through the drain hole or holes, and any water remaining inside the ridge structure may be quickly dried by air circulation. Such air circulation may be facilitated by making the ridge structure substantially hollow.

An object of the invention is to protect roofing materials from environmental damage while allowing water to exit from the roof freely. The ridge structure not only shields and affixes the roofing materials at the roof edge but also allows water to flow over it easily. Although the ridge structure may create an uphill for the water running down a pitched roof in relation to the roof surface, the uphill can still be a slight down slope in relation to the horizontal line if the pitch of the roof is steeper than that of the ridge structure. This unique characteristic can keep the water flow on a pitched roof primarily uninterrupted and deter the accumulation of debris along the ridge structure.

Another object of the invention is improving the appearance of a roof edge. The ridge structure covers the overhang of roofing materials at a roof edge and brings a better finished look. The slope design of the ridge structure can be modified to fit the overall look of a roof, and its surface may incorporate decorative patterns. The ridge structure can also create a high pressure area that pushes down on the roof at times of high wind, which can improve the aerodynamic stability of the roof.

A further advantage of the invention is that roofing materials can be affixed at the roof edge without nailing or screwing on top of the roofing materials. A nail or screw on top of roofing materials is exposed and highly prone to leak. Although sealant can be applied over the nail or screw, it will deteriorate over time. On the other hand, any nail or screw used to affix the ridge structure can be completely covered by roofing materials, and the roofing materials do not require a further affixing means because it is inserted into and secured by the ridge structure.

DETAILED DESCRIPTION

Figure 1:
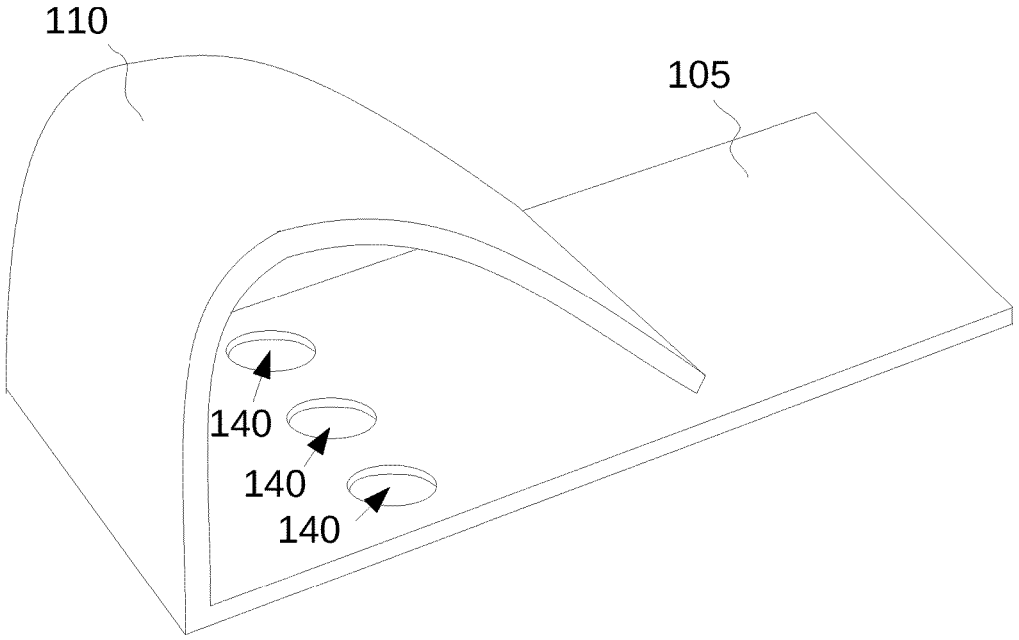
FIG. 1 is a perspective view of a roof edge apparatus having a curved ridge structure.

The invention is related to a roof edge construction where a ridge structure 110 is formed along the edge of a roof. An inner slope 111 of the ridge structure 110 faces the roof surface, and an outer slope 115 that faces the opposite. When installed on a building, an observer on a ground level outside the building would only see the outer slope 155 because the inner slope 110 faces the roof surface and is hidden from the observer's view. When installed on a pitched roof, the inner slope 111 may face upwardly to the sky, and the base panel 105 over which the slopes are situated generally has the same pitch as the roof. The bottom of the outer slope 115 is attached to the base panel 105 whereas the bottom of the inner slope 111 is not. The bottom of the inner slope 111 may touch or not touch the base panel 105, but there is always a long narrow cut between the bottom of the inner slope 111 and the base panel 105. The base panel has a drain hole or holes 140 between the bottoms of the outer slope 115 and the inner slope 111.

Figure 2:
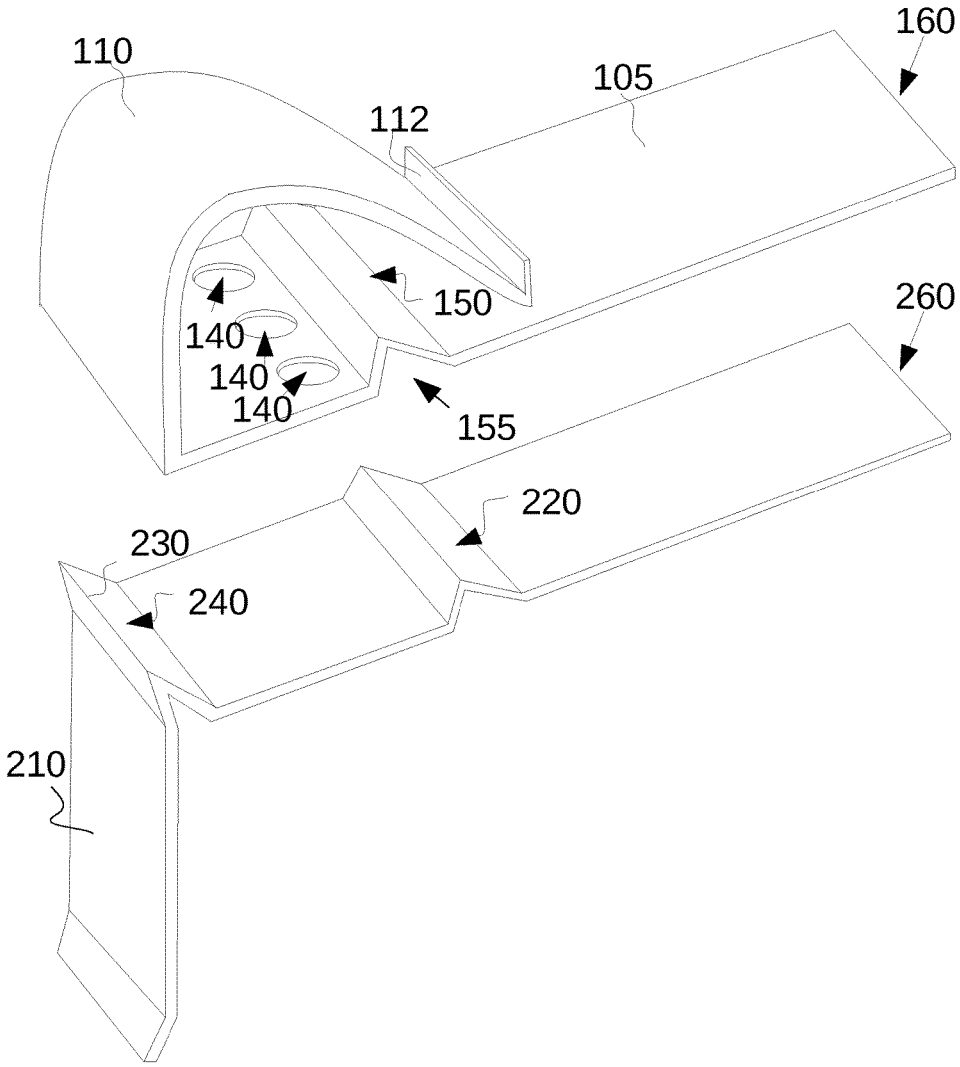
FIG. 2 is a perspective view of a roof edge assembly comprising a roof edge apparatus having a curved ridge structure and a protrusion and a drip edge having two protrusions.

A preferred embodiment of the invention is a roof edge assembly that consists of two metal sheets as shown in FIG. 2. A metal sheet forms a ridge structure 110 and a base panel 105, and the other a drip edge. The drip edge generally lies flat on the roof surface 300 at the edge of the roof and extends beyond the roof edge and bends downward to form a lower edge 210. The base panel 105 of the ridge structure 110 lies flat on top of the drip edge, and a ridge structure 110 is situated at the edge of the roof in a manner that the inner slope 111 generally faces the roof surface. When the roof 300 is covered with a roofing material 330, the roofing material 330 is inserted into the long narrow cut of the ridge structure 110. The outer slope 115 is relatively steep in relation to the horizontal line and forms a wall-like structure along the edge of the roof while the inner slope 111 is much gradual. The tip 112 of the inner slope in and the base panel 105 jointly hold the roofing material 330 between them.

The tip 112 of the inner slope 111 can be lifted manually so that roofing materials of various thickness can be inserted into the ridge structure 110. In the preferred embodiment, the arch made of the outer slope 115 and the inner slope 111 creates a flat form spring which pins the inserted roofing material 330 down on the base panel 105. In other embodiments, the tip 112 may not be easily lifted because the outer slope 115 and the inner slope 111 does not curve in a way creating a flat form spring. The ridge structure 110 may, for example, form a pitched roof-like structure where the ridge structure 110 is rigid and creates sufficient friction between the tip 112 and the roofing material 330 to fasten the rooting material 330 within the ridge structure 110.

The tip 112 of the ridge structure 110 can be manufactured through a hemming process in metalworking. Specifically, the bottom edge of the inner slope in is folded outwardly to rise at the bottom of the inner slope 111. This rise provides a guidance for inserting the roofing material 330 into the ridge structure 110. On the other hand, the tip 112 may be folded inwardly to provide a more friction between the tip 112 and the roofing material 330. Alternatively, the tip 112 may be completely folded to form a closed hem in favor of durability.

Figure 5:
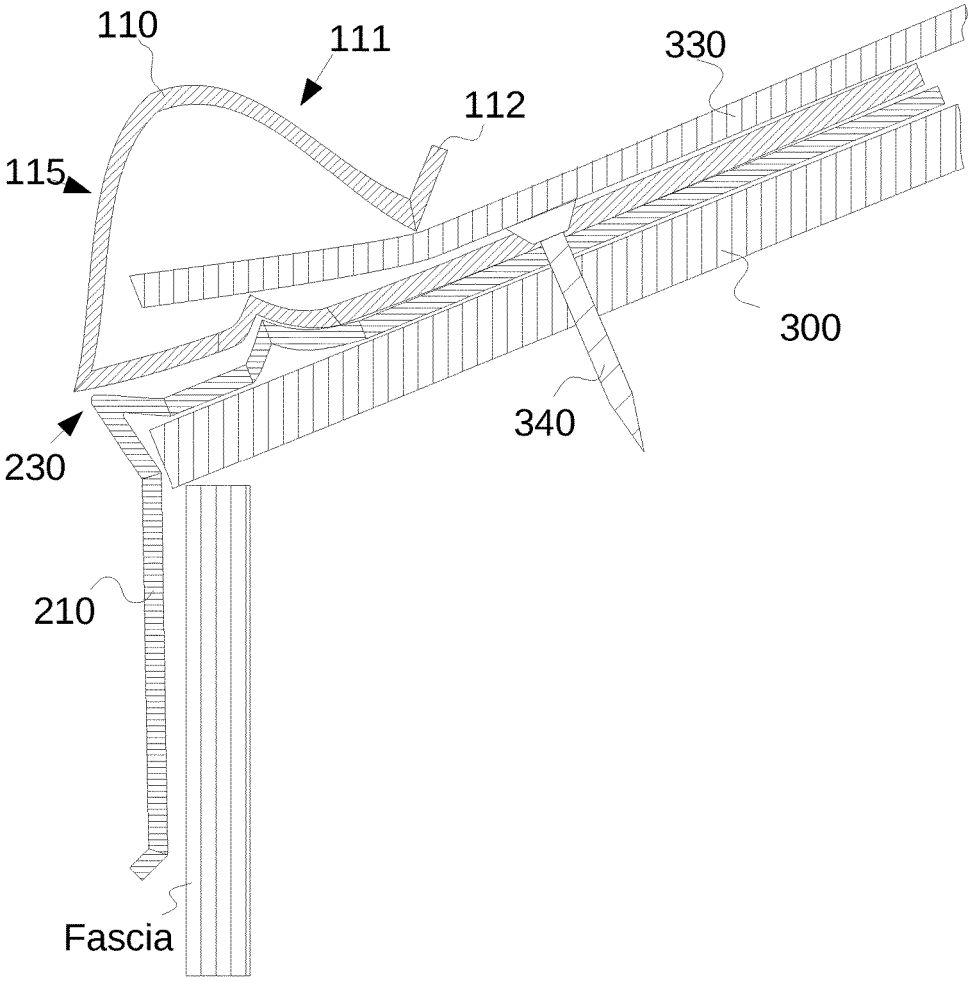
FIG. 5 is a sectional view of a roof edge assembly shown in FIG. 4.

The inner slope 111 allows water to easily flow over the ridge structure 110. In an aspect, the angle of inclination of the inner slope 111 can be smaller than the angle of inclination, or the pitch, of a roof. In this case, the highest point of the ridge structure 110 is vertically lower than the bottom of the inner slope 111. The resulting ridge structure 110 slows down the flow of water on the roof insignificantly. In another aspect, the angle of inclination of the inner slope 111 is larger than the angle of inclination of the roof 300 as shown in FIG. 5. Here, the ridge structure 110 create a bump for the flow of the water, but the length of the inner slope 111 is rather short due to the larger angle.

The outer slope 115 forms a dam along the edge of the roof 300. Although the outer slope 115 poses a dead end for the water flow, it also provides benefit as to the appearance of the roof. As such, roofing materials often project beyond the edge of the roof, and the overhangs can create an unpleasant look over time due to the environmental damage and sagging edges. The outer slope 115 offers a better finished look, and in addition, the surface of the outer slope 115 may be decorated with patterns or finishes. In addition, to the extent that allows a normal water flow, the angle of inclination of the outer slope 115 can be adjusted to fit the overall design of the roof.

It is inevitable that the outer slope 115 would trap water inside the ridge structure 110 because of the existence of a slit between the bottom of the outer slope 115 and the base panel 105. The slit allows the edge side of the roofing material 330 to be inserted and secured but also allows water to flow in or leak into the inside of the ridge structure 110.

Holes 140 can be drilled between the bottom of the outer slope 115 and the line of protrusion 150 below the ridge structure 110. The holes 140 in FIG. 1 and FIG. 2 are of a round and identical shape, aligned in a row, and separated by the distance that is about half the diameter of the hole 140. The round and identical shape of the holes 140 is preferred because of the cheap manufacturing cost, and the distance between the holes 140 may vary. Having more holes 140 help drainage but harm the structural integrity of the base panel 105 of the assembly. The holes 140 can have a rounded or edged rectangular shape or an oval shape although virtually any shape can be used. Holes 140 may be aligned in a row or plurality of rows along the bottom of the outer slope 115. In an alignment, the center of the hole 140 in a row is aligned to the middle point of the centers of the closest two holes 140 in an adjacent row. This alternating alignment can provide better drainage than other alignments with the same hole size, shape and number. In general, the holes 140 may have different shapes, sizes, and alignments as long as they provide sufficient drainage and do not compromise the structural integrity of the base panel 105.

The protrusion 150 lies parallel to and in between of the bottom of the outer slope 115 and the bottom of the inner slope in. The protrusion 150 creates a bump that interferes with the flow of water that enters the ridge structure 110 and deters the back-flow of the same. A preferred method of creating the protrusion 150 is stamping, also known as pressing, which further creates an indentation 155 to the bottom side of the base panel 105. The indentation 155 provides a grip and a guidance in connection with a specifically designed drip edge shown in FIG. 2. As shown, the protrusion 220 lies along the outer edge 230 of the drip edge. The aforementioned indentation 155 can catch the protrusion 220, which will provide a temporary grip for a permanent installation. The grip not only eases the installation of the drip edge assembly but also helps align the ridge structure 110 in relation to neighboring ridge structures 110. The protrusion 150 and the protrusion 220 may exist in plurality on the ridge structure 110 and the drip edge.

The drip edge in FIG. 2 has two lines of protrusion: one along the outer edge 230 and the other that corresponds to the indentation 155 on the base panel 105. The protrusion 240 and the protrusion 220 can create bumps that separate the base panel 105 and the drip edge 200. The gap between the base panel 105 and the drip edge 200 creates a hollow space located under the drain holes 140. The hollow space can help drainage of the ridge structure 110 by allowing water and air to flow into and out. It should be noted that the protrusions are not the only way to create such hollow space. Nor is the hallow space the only way to facilitate the drainage of the ridge structure 110. For example, a hollow space can be created by rolling or bending a portion of a drip edge. Alternatively, the ridge structure 110 can be installed in a way that the ridge structure 110 portion would at least partially project beyond the outer edge 230. The resulting alignment would allow the water exiting the ridge structure 110 through the drain holes 140 to fall along the lower edge 210.

Figure 3:
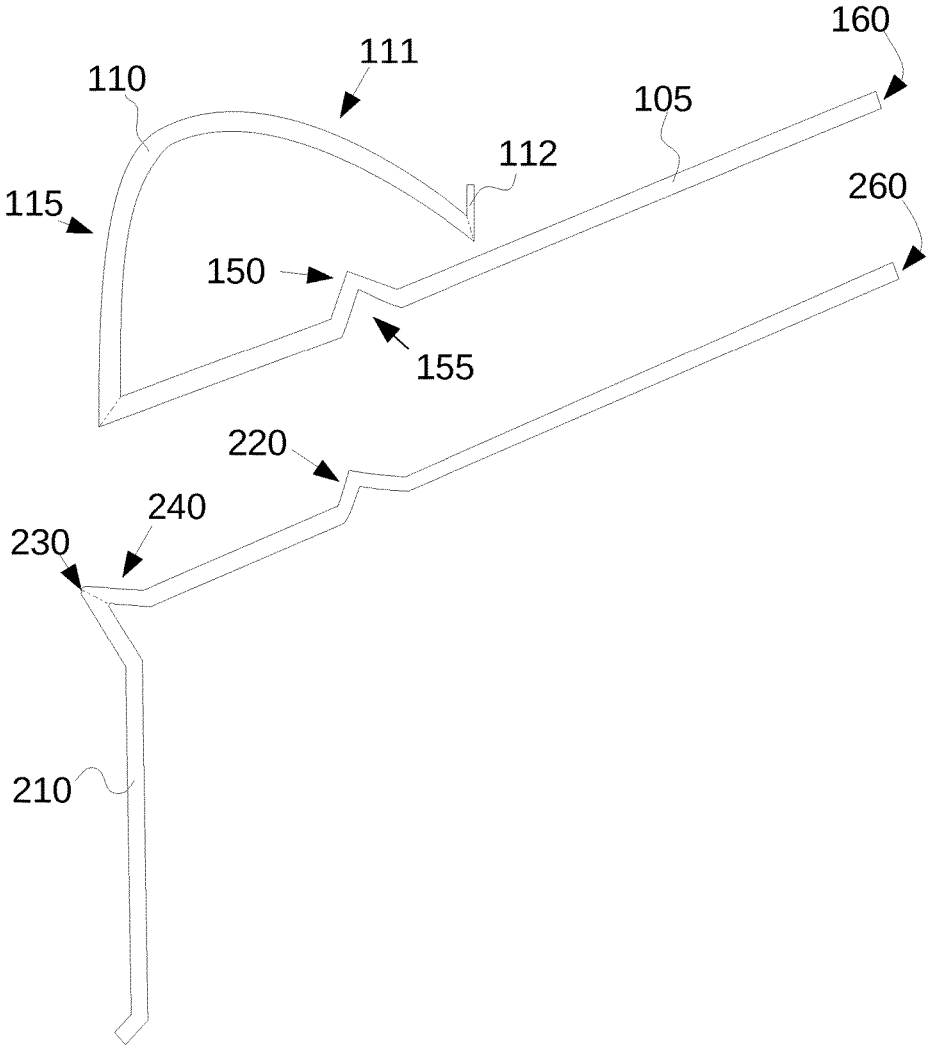
FIG. 3 is a side view of a roof edge assembly comprising a roof edge apparatus having a curved ridge structure and a protrusion and a drip edge having two protrusions.
Figure 4:
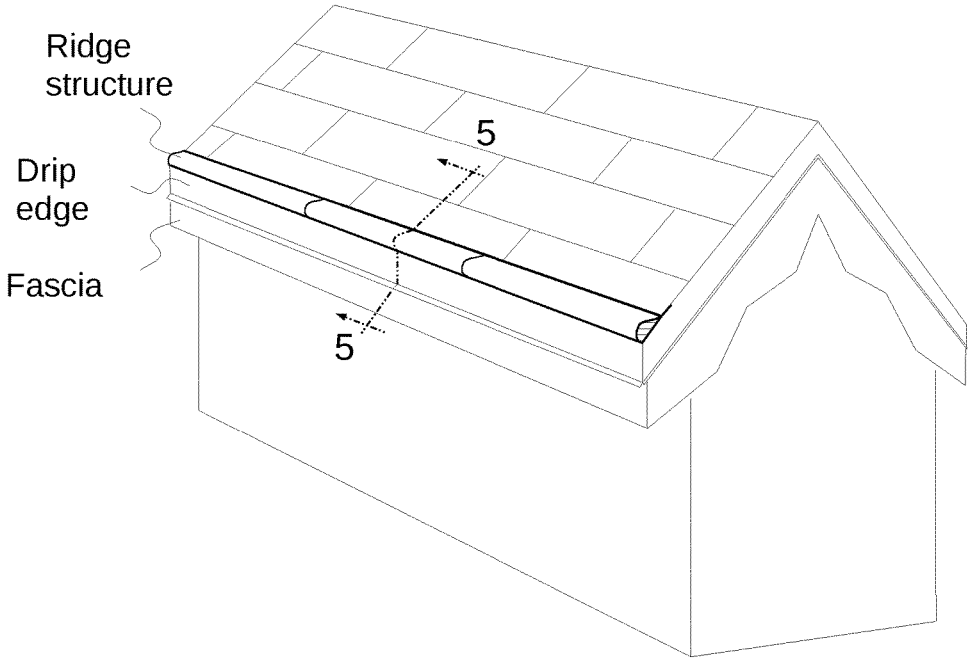
FIG. 4 a perspective view of a roof on a building where a roof edge assembly is installed along an edge of the roof.

The drip edge in FIG. 2 and FIG. 3 has a bottom edge 210 that extends further from the outer edge 230 and aligned parallel to the fascia 315 of the roof. The tip of the bottom edge is slightly bent outwardly to direct water away from the side of the building. The bottom edge 210 can be pulled outwardly because the roof edge assembly is usually installed on the roof with screws 340 only on top of the roof 300 as shown in FIG. 5. This adjustment may be necessary to accommodate other roofing elements such as gutter equipments. However, pulling out the bottom edge 210 may shift the position of the outer edge 230. In certain embodiments, the outer edge 230 rises up against the base panel 105, and the gap between the base panel 105 and the outer edge 230 may decrease or even disappear. In such case, it is preferable for the lower edge 210 to have a preformed or readily adjustable outwardly angle to accommodate other roofing elements.

The above description and embodiments illustrate an example of how a ridge structure no can be used with roofing materials and drip edges, but the invention is not limited to such arrangement. For example, a roof edge that is made of a single metal sheet may fully incorporate the invention. Specifically, a sheet of metal can create functional equivalents of both a ridge structure 110 and a drip edge. The functional equivalents may be identical to the roof edge assembly in the FIG. 2 except that the the inner edge 260 and the inner end 160 of the ridge structure 110 are connected. This embodiment may be more difficult to manufacture, but the connection between the inner edge 260 and the inner end 160 creates a water barrier to the back-flow of water through the gap between the ridge structure 110 and the drip edge.

Although embodiments made of one or two metal pieces are described herein, metal is chosen in consideration of the low cost of manufacturing. Other materials can easily replace metal in favor of other characteristics. For example, plastic is a durable and inexpensive material. When plastic is used, the entire roof edge assembly shown in FIG. 2 and FIG. 3 can be easily created in one piece through a molding process.

A person of ordinary skill would recognize that the exact dimensions and the shape of the ridge structure 110 and the base panel 105 as well as the dimension and the manner of constructing the drain holes 140 should be decided upon various factors including the characteristics of a roof, the type of roofing materials, and the environmental factors. The designs of the embodiments described or shown herein do not limit the implementation of the invention, whose gist lies on the triple function of the ridge structure 110 that pins down the roofing materials 330, covers the edge of roofing materials 330, and allows water to exit the roof.

The invention claimed is:

1. A roof edge assembly, said assembly comprising:

a drip edge that includes an upper edge, an inner edge and a lower edge, and a flange portion extending between the upper edge and the inner edge, wherein the flange portion is positioned under a roofing material along a roof edge;

a base panel positioned over the drip edge but under the roofing material along the roof edge, the base panel having a plurality of drain holes and an extended flange portion that provides a multilateral surface with four or more sides for laying a first row of said roofing materials, wherein an outer side of the base panel is aligned with the roof edge; and a unitary extension of the base panel that forms a ridge structure over the base panel, said ridge structure comprising:

an inner slope that is parallel to the roof edge and facing one side thereof wherein a narrow cut is located between a bottom of said inner slope and the base panel; and an outer slope that is parallel to the roof edge and facing an opposite side thereof wherein a bottom of said outer slope is attached to the outer side of the base panel;

wherein a curvature of the inner and outer slopes of the ridge structure forms a flat form spring pressing down on the base panel so that the roofing material is secured between the ridge structure and the base panel.

2. The roof edge assembly as in claim 1 wherein the base panel has a protrusion positioned in parallel to and in between the bottom of the inner slope and the bottom of the outer slope, the protrusion of the base panel being coextensive with a first protrusion located on the drip edge.

3. The roof edge assembly as in claim 1, wherein a second protrusion located on the drip edge is configured to distance the base panel from the drip edge, whereby a gap is created between the drain holes of the base panel and the drip edge.

4. The roof edge assembly as in claim 3, further comprising a line of indentation or a bent located on the lower edge of the drip edge, in parallel to the roof edge.

5. A method of constructing a ridge structure along a roof edge of a roof, said method comprising:

providing the roof edge assembly of claim 1;

screwing down the base panel composed of metal on the roof edge wherein the panel projects beyond the roof edge;

installing the roofing material on the roof, wherein the roofing material covers screws on the panel but leaves a portion of the panel projecting beyond the roof edge uncovered;

making the drain holes on the uncovered portion of the panel; and bending the uncovered portion of the panel toward a roof surface.

* * * * *